US007937272B2

(12) United States Patent
Oomen et al.

(10) Patent No.: US 7,937,272 B2
(45) Date of Patent: May 3, 2011

(54) SCALABLE ENCODING/DECODING OF AUDIO SIGNALS

(75) Inventors: Arnoldus Werner Johannes Oomen, Eindhoven (NL); Leon Maria Van De Kerkhof, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 964 days.

(21) Appl. No.: 11/813,105

(22) PCT Filed: Jan. 6, 2006

(86) PCT No.: PCT/IB2006/050055

§ 371 (c)(1),
(2), (4) Date: Jun. 29, 2007

(87) PCT Pub. No.: WO2006/075269

PCT Pub. Date: Jul. 20, 2006

(65) Prior Publication Data

US 2008/0154615 A1 Jun. 26, 2008

(30) Foreign Application Priority Data

Jan. 11, 2005 (EP) ..... 05100124
May 27, 2005 (EP) ..... 05104571

(51) Int. Cl.
*G10L 21/00* (2006.01)

(52) U.S. Cl. ..... 704/500; 704/201; 375/240.23

(58) Field of Classification Search ..... 704/201, 704/500; 375/240.23

See application file for complete search history.

(56) References Cited

U.S. PATENT DOCUMENTS

| | | | | |
|---|---|---|---|---|
| 6,529,604 | B1 | 3/2003 | Park et al. | |
| 7,333,929 | B1 * | 2/2008 | Chmounk et al. | 704/200 |
| 2004/0176948 | A1 * | 9/2004 | Oh et al. | 704/201 |
| 2004/0184537 | A1 | 9/2004 | Geiger et al. | |
| 2005/0010396 | A1 | 1/2005 | Chiu et al. | |
| 2005/0053242 | A1 | 3/2005 | Henn et al. | |
| 2005/0175197 | A1 * | 8/2005 | Melchior et al. | 381/310 |
| 2005/0226426 | A1 * | 10/2005 | Oomen et al. | 381/23 |

FOREIGN PATENT DOCUMENTS

EP 1376538 A1 1/2004

* cited by examiner

*Primary Examiner* — Daniel D Abebe

(57) ABSTRACT

An audio signal is encoded by a first waveform encoder (103) to generate a first waveform based bit-stream component. A second encoder (105) encodes the audio signal to generate a second bit-stream component comprising first enhancement data and a third encoder (107) encodes the audio signal to generate a third bit-stream component comprising second enhancement data for the first waveform based bit-stream component. The first and second bit-stream components correspond to a first representation of the audio signal and the first and third bit-stream components correspond to a second representation of the audio signal. A scalable audio bit-stream is generated by a bit-stream generator (109). The different representations may be selected between by a decoder thereby allowing a flexible and scalable bit-stream to be communicated. The second encoder (105) may specifically be a waveform encoder and the third encoder (107) may specifically be a parametric encoder.

28 Claims, 9 Drawing Sheets

SCALABLE ENCODING/DECODING OF AUDIO SIGNALS

The invention relates to encoding and/or decoding of audio signals and in particular to a scalable representation of audio signals.

Digital encoding of various source signals has become increasingly important over the last decades as digital signal representation and communication progressively has replaced analogue representation and communication. For example, mobile telephone systems, such as the Global System for Mobile communication, are based on digital speech encoding. Also distribution of media content, such as video and music, is increasingly based on digital content encoding.

In the context of audio and video coding, scalability of the encoded signal is advantageous and provides for flexible distribution and processing of the encoded signal. For example, an encoded signal may be scalable in terms of quality, bit-rate and complexity. A specific example for video coding is the progressive quality of JPEG (Joint Picture Expert Group) pictures. In audio coding, a scalable bit-stream enabling fast transcoding to lower quality is a known concept.

Scalability offers the possibility for e.g. a server to deliver adapted streams for each device it addresses. The adaptation consists in transmitting part of a prepared stream (made scalable), which uses a layered structure with priority levels in order to reduce transmission bandwidth. This unique stream is made of different layers that are facultative for the decoders: if all the layers are transmitted and decoded, the quality is optimum, but only the first layer is necessary for allowing signal restitution. Obviously the more scalability layers that are received/used, the better the quality is, but the higher the bit-rate is. Scalability can be coarse-grained with large steps (usually a few kbps per step) or can also be with fine granularity (Fine Granular Scalability). The latter allows cutting anywhere in the initial stream, not only at layers boundaries.

Ideally, the encoder is able to deliver a bit-stream that inherently offers fine grain scalability, such that a bit-stream with any desired bit-rate can be extracted simply by discarding components. However, such flexible coders tend to be inefficient in comparison to dedicated encoders, which do not offer this functionality and are therefore not competitive for many applications. Alternatively, bit-rate scalable bit-streams can be constructed by amending an efficient waveform core coder with a residual coder that optionally offers scalability in small steps. For the lower quality, the residual component may simply be discarded. Such approaches are less flexible but more efficient and thus competitive.

With the advent of new coders based on parametric coding techniques such as SBR (Spectral Band Replication) and PS (Parametric Stereo), scalability becomes less efficient since a residual signal obtained by subtracting the parametric coded representation from the original signal still has high entropy. Specifically, the parametric coded signal tends not to resemble the original audio signal due to the audio source model used in parametric coding. Accordingly, coding a residual signal obtained through parametric coding, having high entropy is not efficient, as it requires a relatively high bit-rate.

An example of an audio encoding standard is the MPEG4 (Moving Picture Expert Group 4) standard. In fact, rather than standardizing a single audio encoding/decoding algorithm, MPEG4 standardizes a number of encoding and decoding parameters and techniques which together forms an encoding/decoding toolset that may be selected from. MPEG4 allows for some of the coders and tools to be combined. Thus, MPEG4 provides a highly flexible and efficient encoding and decoding system for audio signals.

Perhaps the best-known audio coder standardized by MPEG4 is the Advanced Audio Coding AAC audio coder. MPEG4 allows AAC to be combined with other encoders such as an SBR or PS encoder (known as HE-AAC and HE-AAC v2 respectively).

Furthermore, MPEG4 also allows for an encoding that caters for scalability.

For example, MPEG4 defines a Bit Sliced Arithmetic Coding (BSAC) technique, which replaces the noiseless coding core of an AAC coder by a scheme allowing fine granularity. BSAC may provide scalability at steps down to 1 kbps per channel.

Large grain scalability (e.g. 8 kbps steps) is possible using scalability in combination with AAC. Scalability layers can be added in order to improve quality when bandwidth is available. These enrichment layers can be coded with a scheme similar to AAC named AAC Scalable. This scalable scheme can be used to support bit-rate and bandwidth scalability. A large number of scalable combinations are available, including combinations with other techniques (like TwinVQ and CELP coder tools). Channel scalability is also possible and allows going from a mono to a stereo signal in a few layers.

It should be noted that not all combinations of MPEG4 tools are defined. However, some combinations have been implemented and are formalized in so-called MPEG4 profiles.

Bit-rate scalable bit-streams are often constructed by using a (state-of-the-art) waveform coder as a core coder and combining this with a residual coder to generate further enhancement data. One or both of the core coder and the residual coder may offer scalability in large or small steps.

However, such a system is not optimal in all situations. In particular, it tends to result in a suboptimal quality to bit-rate ratio in comparison to other non-scalable coders. Furthermore, the described approach is not practical for the recently introduced coders employing parametric coding techniques, such as SBR and Parametric Stereo, because the residual signal in such cases still inhibits high entropy and therefore requires a high bit-rate for encoding. Furthermore, the system is relatively inflexible and tends to provide only a limited scalability.

Hence, an improved system for encoding and/or decoding would be advantageous and in particular a system allowing increased flexibility, improved quality to data rate ratio, improved scalability, practical implementation, suitability for parametric coding/decoding techniques and/or improved performance would be advantageous.

Accordingly, the Invention seeks to preferably mitigate, alleviate or eliminate one or more of the above-mentioned disadvantages singly or in any combination.

According to a first aspect of the invention there is provided a decoder for generating an audio signal from a scalable audio bit-stream, the decoder comprising: means for receiving the scalable audio bit-stream comprising a first waveform based bit-stream component, a second bit-stream component and a third bit-stream component, the first waveform based bit-stream component and the second bit-stream component corresponding to a first representation of the audio signal and the first waveform based bit-stream component and the third bit-stream component corresponding to a second representation of the audio signal; a first waveform decoder for generating a first decoded signal by decoding the first waveform based bit-stream component; and at least one of: a second decoder for generating the audio signal by modifying the first decoded signal in response to the second bit-stream component, and a third decoder for generating the audio signal by modifying the first decoded signal in response to the third bit-stream component.

The invention may provide for an improved scalability of a scalable audio bit-stream. The invention may for example facilitate or improve distribution and/or transmission of encoded audio signals. A flexible system may be achieved and/or an improved quality to data rate ratio trade off suited for the specific conditions may be selected in many systems. The invention may in particular exploit advantages of new encoding/decoding techniques while maintaining compatibility with existing techniques. Improved backwards compatibility and facilitated introduction of new encoders/decoders may be achieved in many applications.

Differently scaled signals may be obtained from the scalable audio bit-stream by a low complexity processing. Specifically, representations with different bit rates may typically be obtained simply by selecting different bit-stream components.

The scalable audio bit-stream may comprise alternative representations of the same audio signal based on the same base encoding. The audio signal may be represented by a mandatory shared bit-stream combined with one of two alternatively additional bit-stream components. It will be appreciated that in some embodiments, further bit-stream components may be present in the scalable audio bit-stream including further alternative bit-stream components corresponding to further representations of the audio signal.

The decoding by the second decoder and/or the third decoder may comprise determination of a residual signal for the first waveform based bit-stream component. The residual signal may specifically correspond to a difference between the signal represented by the first waveform based bit-stream component and the audio signal.

The audio signal may for example be a single channel or multi-channel audio signal. The scalable audio bit-stream may e.g. be scalable in terms of quality, bit-rate and/or complexity According to an optional feature of the invention, the second bit-stream component is a waveform based bit-stream component and the second decoder is a waveform decoder.

This may allow a particularly advantageous performance and may in many applications allow an improved compatibility with existing audio signal communication and distributions systems.

Waveform based bit-stream components are understood to be generated by waveform coders/coding methods. In waveform coding the objective is to minimize the coding error or residual signal, which is the difference between the original signal and the coded representation. Perceptual audio coding is a special case of waveform coding where this error is perceptually weighted prior to minimization. Perceptual audio coders exploit perceptual irrelevancy, which is represented by those signal components that cannot be perceived by the human hearing system. Such signal components can therefore be more coarsely quantized than other signal components. This weighting is determined by a psychoacoustic model of the human hearing system. Generally, for a higher number of bits, this coding error will decrease.

In some embodiments, both the second and third decoders are waveform decoders.

According to an optional feature of the invention, the third bit-stream component is a parametric based bit-stream component and the third decoder is a parametric decoder.

This may allow a particularly advantageous performance and may allow efficient encoding of a data signal with a high quality to data rate ratio.

The use of a parametric encoding/decoding may allow a performance close to (or identical) to that which can be achieved for dedicated non-scalable encoders/decoders. Also the data rate increase of including the third bit-stream component tends to be acceptable and is typically required only for higher data rates and quality levels where this is more acceptable.

Parametric bit-stream components are understood to be generated by parametric coders/coding methods. In parametric coding the objective is to minimize the difference between the perceptual quality of the original and the coded representation. Therefore the coded signal can be significantly different from the original signal resulting in a large error or residual signal. The perceptual quality is measured by means of a psychoacoustic model of the human hearing system. Besides a perceptual model, parametric audio coders also employ a signal model, for modeling the source. Generally, for a higher number of bits, the quality will saturate to that of the signal model.

In some embodiments, both the second and third decoders are parametric decoders.

In some embodiments, the second decoder is a waveform decoder and the third decoder is a parametric decoder. The encoded signal may be optimized by the individual advantages of waveform coding and parametric coding may be exploited.

According to an optional feature of the invention, an encoding quality of the first representation is higher than of the second representation.

The invention may allow for efficient scalability and may allow for different quality levels to be achieved in the same bit-stream.

According to an optional feature of the invention, the decoder comprises both the second decoder and the third decoder and means for selecting between the second decoder and the third decoder for decoding of the scalable audio bit-stream.

This may allow for an efficient and flexible decoder. The decoder may for example distribute the audio signal to different destinations with the different quality levels and/or requirements. The decoder may be part of a transcoder capable of producing signals with different qualities.

According to an optional feature of the invention, the first waveform decoder is an MPEG-2 or MPEG-4 Advanced Audio Coding, AAC decoder. The invention may provide improved performance and scalability for an AAC encoded audio signal.

According to an optional feature of the invention, the first waveform decoder is an MPEG 2 Layer II, LII decoder. The invention may provide improved performance and scalability for an MPEG 2 LII encoded audio signal.

According to an optional feature of the invention, the third decoder is a Parametric Stereo, PS decoder. The invention may allow particularly advantageous performance and scalability by efficient and flexible encoding of a stereo signal. A Parametric Stereo decoding may provide for a bit-stream component having characteristics which complements a waveform based bit-stream component particularly well.

According to an optional feature of the invention, the third decoder is a MPEG-4 Spectral Band Replication, SBR decoder. The invention may allow particularly advantageous performance and scalability by efficient and flexible encoding of a stereo signal. A Spectral Band Replication decoding may provide for a bit-stream component having characteristics which complements a waveform based bit-stream component particularly well.

According to an optional feature of the invention, the third decoder is a Spatial Audio Coder, SAC decoder. The invention may allow particularly advantageous performance and scalability by efficient and flexible spatial audio encoding of a signal. A Spatial Audio Coder decoding may provide for a bit-stream component having characteristics which complements a waveform based bit-stream component particularly well.

According to an optional feature of the invention, the second decoder is a Scaleable to Lossless Standard, SLS decoder. The invention may allow particularly advantageous performance and scalability by efficient and flexible lossless audio encoding of a signal. A Scaleable to Lossless Standard decoding may provide for a bit-stream component having characteristics which complements a parametric bit-stream component particularly well. Specifically, a parametric bit-stream component may provide for an efficiently encoded signal at modest data rates whereas an SLS based bit-stream component may provide for a particularly high encoding quality. For example, some signals may be particularly suited for parametric encoding because they closely match a parametric model whereas other signals may be particularly well encoded by waveform encoding because they do not match parametric models as well.

According to an optional feature of the invention, the second decoder is an MPEG-2 or MPEG-4 Advanced Audio Coding, AAC, decoder. The invention may allow particularly advantageous performance and scalability by efficient and flexible AAC encoding of a signal. An AAC decoding may provide for a bit-stream component having characteristics which complements a parametric bit-stream component particularly well.

According to an optional feature of the invention, the second decoder is an MPEG 2 Layer II, LII multi channel extension decoder. The invention may allow particularly advantageous performance and scalability by efficient and flexible extension encoding of a signal. An MPEG 2 LII multi channel extension decoding may provide for a bit-stream component having characteristics which complements a parametric bit-stream component particularly well.

According to an optional feature of the invention, the decoder is an MPEG 4 decoder. In particular, all decoders and the scalable audio bit-stream may individually comply with the MPEG-4 standard. Thus, all decoders and decoding algorithms may be selected from the MPEG-4 toolbox of defined algorithms and requirements.

According to an optional feature of the invention, the scalable audio bit-stream further comprises enhancement data for the audio signal relative to the first representation; and the decoder further comprises means for generating the audio signal in response to the enhancement data.

This may further improve the scalability and/or the quality of a decoded signal. The enhancement data may correspond to an encoding of a residual signal of the audio signal relative to the first representation of the audio signal. The enhancement data may specifically comprise a bit-stream component from SLS coding of the residual signal.

According to an optional feature of the invention, the scalable audio bit-stream further comprises enhancement data for the audio signal relative to the second representation; and the decoder further comprises means for generating the audio signal in response to the enhancement data.

This may further improve the scalability and/or the quality of a decoded signal. The enhancement data may correspond to an encoding of a residual signal of the audio signal relative to the second representation of the audio signal. The enhancement data may specifically comprise a bit-stream component from an SLS coding of the residual signal.

According to an optional feature of the invention, the scalable audio bit-stream further comprises a fourth bit-stream component; and the decoder comprises a fourth decoder for generating the audio signal by modifying the first decoded signal in response to the fourth bit-stream component.

The first waveform based bit-stream component and the fourth bit-stream component may correspond to a third representation of the audio signal. The feature may provide improved flexibility, performance and/or scalability. For example, the third bit-stream component may be a Parametric Stereo encoded signal and the fourth bit-stream component may be a Spectral Band Replication encoded signal.

According to a second aspect of the invention there is provided an encoder for encoding an audio signal in a scalable audio bit-stream, the encoder comprising: a first waveform encoder for encoding the audio signal into a first waveform based bit-stream component; a second encoder for encoding the audio signal to generate a second bit-stream component comprising first enhancement data for the first waveform based bit-stream component, the first waveform based bit-stream component and the second bit-stream component corresponding to a first representation of the audio signal; a third encoder for encoding the audio signal to generate a third bit-stream component comprising second enhancement data for the first waveform based bit-stream component, the first waveform based bit-stream component and the third bit-stream component corresponding to a second representation of the audio signal; and means for generating the scalable audio bit-stream comprising the first waveform based bit-stream component, the second bit-stream component and the third bit-stream component.

The invention may provide for an improved scalability of a scalable audio bit-stream. The invention may for example facilitate or improve distribution and/or transmission of encoded audio signals. A flexible system may be achieved and/or an improved quality to data rate ratio trade off suited for the specific conditions may be selected in many systems. The invention may in particular exploit advantages of parametric encoding/decoding. Furthermore, improved backwards compatibility and facilitated introduction of new encoders/decoders may be achieved in many applications.

The encoding by the second encoder and/or the third encoder may comprise determination of a residual signal for the first waveform based bit-stream component. The residual signal may specifically correspond to a difference between the signal represented by the first waveform based bit-stream component and the audio signal.

It will be appreciated that the optional features, comments and/or advantages described above with reference to the decoder tend to apply equally well to the encoder and that the corresponding optional features may be included in the encoder individually or in any combination.

According to a third aspect of the invention there is provided a method of generating an audio signal from a scalable audio bit-stream, the method comprising:

receiving the scalable audio bit-stream comprising a first waveform based bit-stream component, a second bit-stream component and a third bit-stream component, the first waveform based bit-stream component and the second bit-stream component corresponding to a first representation of the audio signal and the first waveform based bit-stream component and the third bit-stream component corresponding to a second representation of the audio signal; generating a first decoded signal by decoding the first waveform based bit-stream component; and at least one of: generating the audio signal by modifying the first decoded signal in response to the second bit-stream component, and generating the audio signal by modifying the first decoded signal in response to the third bit-stream component.

According to a fourth aspect of the invention there is provided a method of encoding an audio signal in a scalable audio bit-stream, the method comprising: encoding the audio signal into a first waveform based bit-stream component; encoding the audio signal to generate a second bit-stream component comprising first enhancement data for the first waveform based bit-stream component, the first waveform based bit-stream component and the second bit-stream component corresponding to a first representation of the audio signal; encoding the audio signal to generate a third bit-stream component comprising second enhancement data for the first waveform based bit-stream component, the first waveform based bit-stream component and the third bit-stream component corresponding to a second representation of the audio signal; and generating the scalable audio bit-stream comprising the first waveform based bit-stream component, the second bit-stream component and the third bit-stream component.

According to a fifth aspect of the invention, there is provided a scalable audio bit-stream for an audio signal comprising a first waveform based bit-stream component, a second bit-stream component and a third bit-stream component, the first waveform based bit-stream component and the second bit-stream component corresponding to a first representation of the audio signal and the first waveform based bit-stream component and the third bit-stream component corresponding to a second representation of the audio signal.

According to a sixth aspect of the invention, there is provided a storage medium, in the form of a non-transitory computer-readable storage medium, having stored thereon such a signal.

According to a seventh aspect of the invention, there is provided a receiver for receiving a scalable audio bit-stream, the receiver comprising: means for receiving the scalable audio bit-stream comprising a first waveform based bit-stream component, a second bit-stream component and a third bit-stream component, the first waveform based bit-stream component and the second bit-stream component corresponding to a first representation of the audio signal and the first waveform based bit-stream component and the third bit-stream component corresponding to a second representation of the audio signal; a first waveform decoder for generating a first decoded signal by decoding the first waveform based bit-stream component; and at least one of: a second decoder for generating the audio signal by modifying the first decoded signal in response to the second bit-stream component, and a third decoder for generating the audio signal by modifying the first decoded signal in response to the third bit-stream component.

According to an eight aspect of the invention, there is provided a transmitter for transmitting an audio signal in a scalable audio bit-stream, the transmitter comprising: a first waveform encoder for encoding the audio signal into a first waveform based bit-stream component; a second encoder for encoding the audio signal to generate a second bit-stream component comprising first enhancement data for the first waveform based bit-stream component, the first waveform based bit-stream component and the second bit-stream component corresponding to a first representation of the audio signal; a third encoder for encoding the audio signal to generate a third bit-stream component comprising second enhancement data for the first waveform based bit-stream component, the first waveform based bit-stream component and the third bit-stream component corresponding to a second representation of the audio signal; means for generating the scalable audio bit-stream comprising the first waveform based bit-stream component, the second bit-stream component and the third bit-stream component; and means for transmitting the scalable audio bit-stream.

According to a ninth aspect of the invention, there is provided a transmission system for transmitting an audio signal, the transmission system comprising: a transmitter comprising: a first waveform encoder for encoding the audio signal into a first waveform based bit-stream component, a second encoder for encoding the audio signal to generate a second bit-stream component comprising first enhancement data for the first waveform based bit-stream component, the first waveform based bit-stream component and the second bit-stream component corresponding to a first representation of the audio signal, a third encoder for encoding the audio signal to generate a third bit-stream component comprising second enhancement data for the first waveform based bit-stream component, the first waveform based bit-stream component and the third bit-stream component corresponding to a second representation of the audio signal, means for generating the scalable audio bit-stream comprising the first waveform based bit-stream component, the second bit-stream component and the third bit-stream component, and means for transmitting the scalable audio bit-stream; and a receiver comprising: means for receiving the scalable audio bit-stream, a first waveform decoder for generating a first decoded signal by decoding the first waveform based bit-stream component, and at least one of: a second decoder for generating the audio signal by modifying the first decoded signal in response to the second bit-stream component, and a third decoder for generating the audio signal by modifying the first decoded signal in response to the third bit-stream component.

According to a tenth aspect of the invention, there is provided a method of receiving an audio signal from a scalable audio bit-stream, the method comprising: receiving the scalable audio bit-stream comprising a first waveform based bit-stream component, a second bit-stream component and a third bit-stream component, the first waveform based bit-stream component and the second bit-stream component corresponding to a first representation of the audio signal and the first waveform based bit-stream component and the third bit-stream component corresponding to a second representation of the audio signal; generating a first decoded signal by decoding the first waveform based bit-stream component; and at least one of: generating the audio signal by modifying the first decoded signal in response to the second bit-stream component, and generating the audio signal by modifying the first decoded signal in response to the third bit-stream component.

According to an eleventh aspect of the invention, there is provided a method of transmitting an audio signal in a scalable audio bit-stream, the method comprising: encoding the audio signal into a first waveform based bit-stream component; encoding the audio signal to generate a second bit-stream component comprising first enhancement data for the first waveform based bit-stream component, the first waveform based bit-stream component and the second bit-stream component corresponding to a first representation of the audio signal; encoding the audio signal to generate a third bit-stream component comprising second enhancement data for the first waveform based bit-stream component, the first waveform based bit-stream component and the third bit-stream component corresponding to a second representation of the audio signal; generating the scalable audio bit-stream comprising the first waveform based bit-stream component, the second bit-stream component and the third bit-stream component; and transmitting the scalable audio bit-stream.

According to a twelfth aspect of the invention, there is provided a method of transmitting and receiving an audio signal, the method comprising: encoding the audio signal into a first waveform based bit-stream component; encoding the audio signal to generate a second bit-stream component comprising first enhancement data for the first waveform based bit-stream component, the first waveform based bit-stream component and the second bit-stream component corresponding to a first representation of the audio signal; encoding the audio signal to generate a third bit-stream component comprising second enhancement data for the first waveform based bit-stream component, the first waveform based bit-stream component and the third bit-stream component corresponding to a second representation of the audio signal; generating the scalable audio bit-stream comprising the first waveform based bit-stream component, the second bit-stream component and the third bit-stream component; transmitting the scalable audio bit-stream; receiving the scalable audio bit-stream; generating a first decoded signal by decoding the first waveform based bit-stream component; and at least one of: generating the audio signal by modifying the first decoded signal in response to the second bit-stream component, and generating the audio signal by modifying the first decoded signal in response to the third bit-stream component.

According to a thirteenth aspect of the invention, there is provided a computer program product in the form of a non-transitory computer-readable storage medium embodying a computer program with instructions for causing a processor to execute any of the methods previously described.

According to a fourteenth aspect of the invention, there is provided an audio playing device comprising a decoder as previously described.

According to a fifteenth aspect of the invention, there is provided an audio recording device comprising an encoder as previously described.

These and other aspects, features and advantages of the invention will be apparent from and elucidated with reference to the embodiment(s) described hereinafter.

Embodiments of the invention will be described, by way of example only, with reference to the drawings, in which FIG. 1 illustrates an encoder in accordance with some embodiments of the invention;

The following description focuses on embodiments of the invention compatible with audio encoding according to the MPEG-4 standard. However, it will be appreciated that the invention is not limited to this application but may be applied to many other encoding/decoding standards or techniques.

Figure 1:
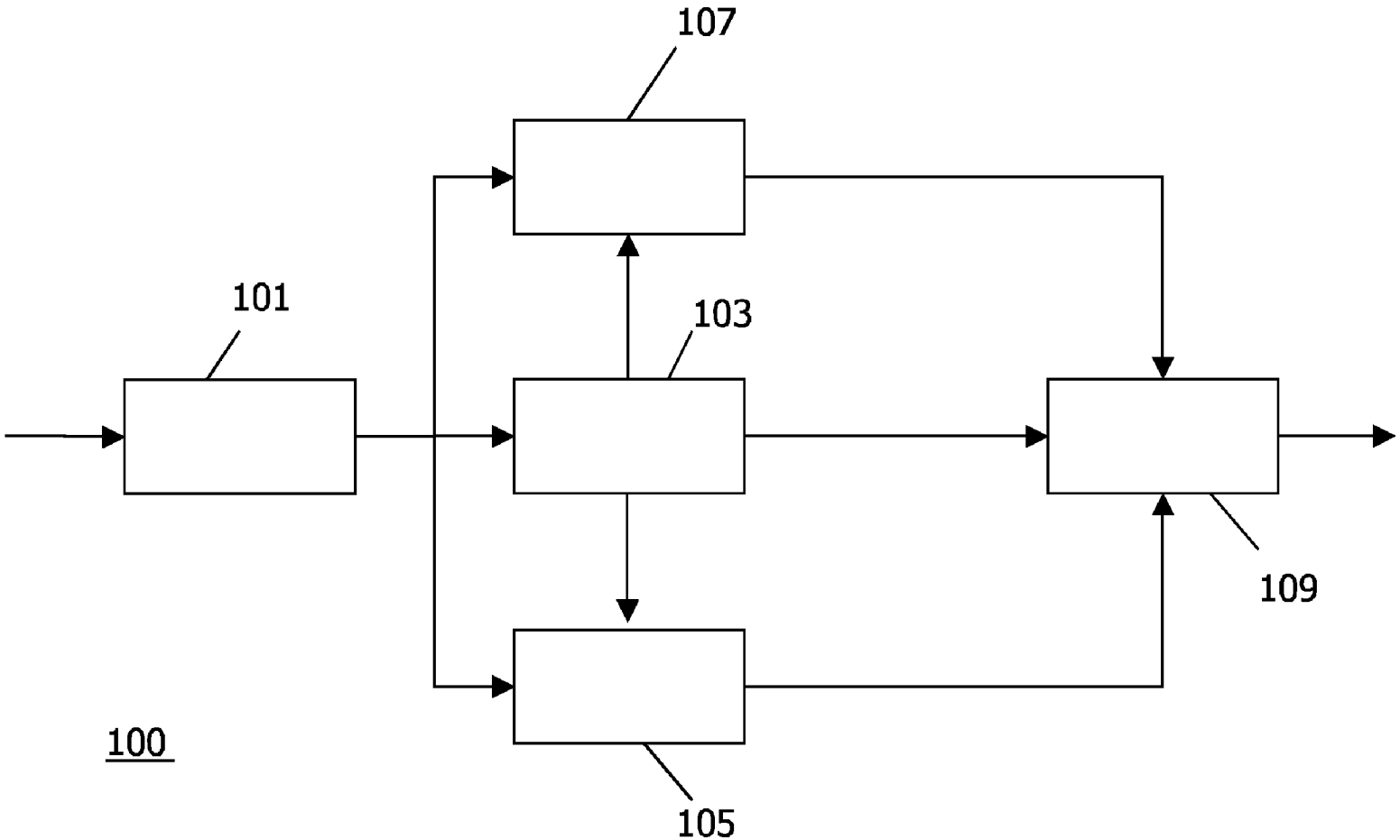

FIG. 1 illustrates an encoder 100 in accordance with some embodiments of the invention.

The encoder 100 comprises a encode receiver 101 which receives an audio signal for encoding. The audio signal may be received from any suitable internal or external source and may for example be in the form of a Pulse Code Modulated (PCM) sampled digital mono audio signal. The encode receiver 101 is coupled to a first waveform encoder 103 which is fed the digitized audio signal.

The first waveform encoder encodes the audio signal to produce a first waveform based bit-stream component. Specifically, the first waveform encoder 103 may use a waveform encoding technique, which is widely used by intended receivers of the encoded signal. For example, in a music distribution system, a large number of users may use a specific decoding algorithm and the first waveform encoder 103 may apply an encoding technique, which is compatible with this decoding algorithm in order to achieve a high degree of compatibility.

In waveform coding, the encoder seeks to minimize the coding error, which is the difference between the original signal and the coded representation. Generally, for an increasing bit-rate this coding error will decrease. Examples of waveform encoding techniques include Scaleable to Lossless Standard, SLS, and Adaptive Differential Pulse Code Modulation (ADPCM) coding. Other examples include perceptual waveform coding techniques wherein a perceptually weighted coding error rather than a strict mathematical distance coding error is minimized. For perceptual waveform encoding, an increasing bit rate results in a decrease of the perceptually weighted coding error. Examples of perceptual waveform coders include AAC (Advanced Audio Coding), MP3 (Motion Picture Expert Group 3), AC3 (Audio Coding 3), CELP (Code-Excited Linear Prediction) etc.

In the encoder 101 of FIG. 1, the first waveform encoder 103 is used as a base encoder, which uses an encoding algorithm providing a bit-stream which is compatible with a large number of intended receivers. However, in the example, the encoding quality level of the first waveform encoder 103 is set relatively low resulting in a reduced data rate for the first bit-stream component. Thus, the first bit-stream component may correspond to a representation of the audio signal where the trade off between data rate and quality is set at an operating point corresponding to a relatively low data rate and quality.

The first waveform encoder 103 may in itself provide a first bit-stream component which has some scalability.

In the encoder 101 of FIG. 1, the encode receiver 101 is further coupled to a second encoder 105. The second encoder 105 also receives the audio signal and proceeds to encode this to generate a second bit-stream component. The second encoder 105 is coupled to the first waveform encoder 103 and proceeds to code the audio signal relative to the representation of the audio signal by the first bit-stream such that the first bit-stream component and the second bit-stream component created by the second encoder 105 together forms a representation of the audio signal. Thus, the data of the second bit-stream component may be considered enhancement data for the first bit-stream component.

In the specific example, the second encoder 105 is a waveform encoder but in other embodiments, the second encoder 105 may for example be a parametric encoder.

As a specific example, the second encoder 105 may generate a residual signal as the difference between the original signal and a re-encoded signal based on the data from the first waveform encoder 103. The resulting difference signal may then be encoded using a waveform encoding algorithm. For example, an SLS algorithm may be used to generate the second bit-stream component. Thus, the first bit-stream component may correspond to a relatively low quality/low data rate representation of the audio signal whereas the first and second bit-stream components together correspond to a relatively higher quality/higher data rate representation of the audio signal.

SLS (Scalable LosslesS) encoding aims at encoding a residual signal in the frequency domain. In the example, this residual signal is the difference between the audio signal and the AAC/BSAC encoded and decoded signal thereof. In this way an AAC/BSAC decoder will handle the lossy part and the lossless decoded signal can be recovered if a perfect representation is needed.

The encode receiver 101 is further coupled to a third encoder 107 which also receives the audio signal. In the specific example of FIG. 1, the third encoder 107 is a parametric encoder using a parametric encoding algorithm to encode the audio signal to generate a third bit-stream component. The parametric coding is performed with reference to the encoding by the first waveform encoder 103. Specifically, the third encoder 107 may generate enhancement data for the first bit-stream component such that the first bit-stream component and the third bit-stream component together correspond to a representation of the audio signal, which is of higher quality (but with increased bit rate) than the representation by the first bit-stream component itself.

It will be appreciated that the third encoder 107 typically will not merely encode a difference signal between the original signal and the encoded signal of the first waveform encoder 103, as this signal may still have high entropy and may not be suitable for parametric encoding. However, the third encoder 107 may encode the audio signal to provide an improved representation of parameters and characteristics of the audio signal which are not fully represented by the first bit-stream. For example, the third encoder 107 may particularly encode higher frequency and/or multi channel components which are not—or only partially—considered by the first waveform encoder 103.

In the example, the third bit-stream component is generated by a parametric coding algorithm. In parametric coding, the encoder seeks to minimize the difference between the perceptual quality of the original and the coded representation. For this purpose, a parametric model is typically used and the parameters of the model are transmitted. Thus, the encoding seeks to provide data allowing the decoder to reproduce the parametric model and excitation signals (as well as possibly a residual signal). For a parametric encoder, there tends not to be a strict relation between the amount of coding error and the number of coding bits. Examples of parametric coders or coding tools include MPEG-4-Harmonics Individual Lines and Noise, HILN, MPEG-4-Harmonic Vector excitation Coding, HVXC, MPEG4-SinuSoidal Coding, SSC (also known as parametric coding for high quality audio), Vo-coders, Spectral Band Replication, Parametric stereo and Spatial audio.

In the embodiment of FIG. 1, the encode receiver 101 feeds the same signal to the first waveform encoder 103, the second encoder 105 and to the third encoder 107 with the second and third encoder 105, 107 encoding the audio signal with reference to the encoding of the audio signal by the first waveform encoder 103. However, it will be appreciated that in other embodiments, the encode receiver 101 may feed different signals to the different encoders. For example, the encode receiver 101 may divide the audio signal into a low frequency signal part and a high frequency signal part and may feed the low frequency part to the first waveform encoder 103 and the high frequency part to the second encoder 10 and the third encoder 107.

The first waveform encoder 103, the second encoder 105 and the third encoder 107 are all coupled to a bit-stream generator 109, which receives the first, second and third bit-stream components from the encoders. The bit-stream generator 109 proceeds to generate an encoded bit-stream comprising the bit-stream components. In addition, the bit-stream generator 109 may include other data such as control data, signalling data, header data, routing data etc. In some embodiments, the bit-stream generator 109 may generate a packetized data stream which may be distributed in a packet based network such as the Internet.

Thus, the encoder 100 generates a scalable audio bit-stream for the audio signal which comprises a first waveform based bit-stream component, a second bit-stream component and a third bit-stream component. Furthermore, the scalable bit-stream comprises alternative representations of the audio signal with the first waveform based bit-stream component and the second bit-stream component corresponding to a first representation of the audio signal and the first waveform based bit-stream component and the third bit-stream component corresponding to a second representation of the audio signal. Furthermore, the waveform based bit-stream component may in itself correspond to an independent representation of the signal.

In contrast to conventional scalable signals, where each scalable layer builds on the previous layers to provide a continuously increasing enhancement, the scalable signal of the encoder 100 provides for alternative and unrelated enhancement data of the audio signal where the decoder may select between the different enhancement data. Thus, the second and third bit-stream components represent alternative information relating to the same signal with both components independently of each other relating to the same base waveform encoded bit-stream. Thus, the first representation may be recreated without consideration of the third bit-stream component and the second representation may be recreated without consideration of the second bit-stream component.

The described embodiments may thus generate a scalable signal with increased flexibility and improved performance. For example, the scalable signal may use the second encoder 105 to generate enhancement data compatible with a large number of existing coders thereby providing backwards compatibility, whereas the third encoder 107 may be used to generate a highly efficient encoded signal using state of the art parametric encoding. Thus, backwards compatibility may be achieved while allowing for newer coding techniques to be introduced.

Figure 2:
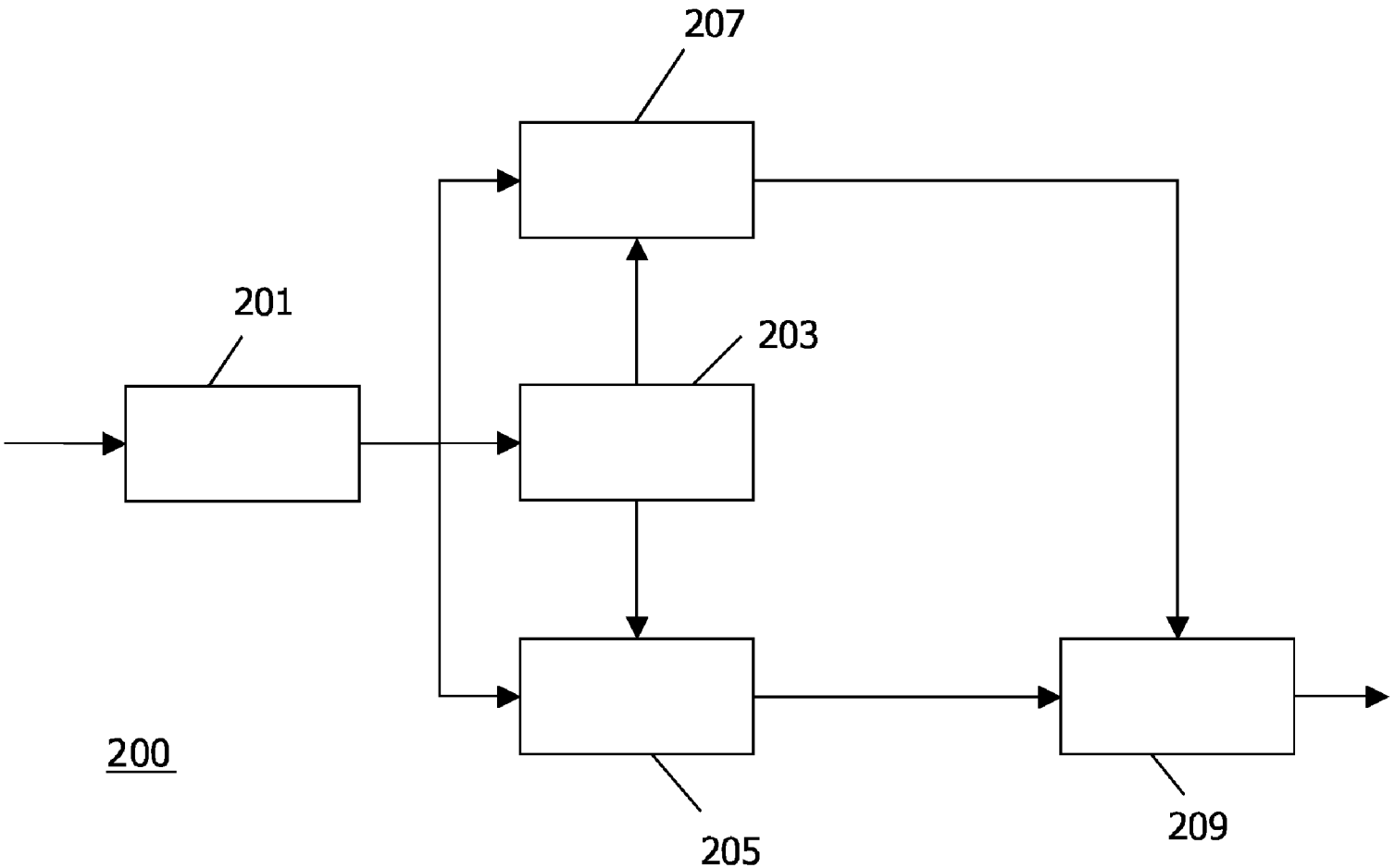
FIG. 2 illustrates a decoder in accordance with some embodiments of the invention.

FIG. 2 illustrates a decoder 200 in accordance with some embodiments of the invention.

The decoder comprises a decode receiver 201 which receives a scalable audio bit-stream. Specifically, the decode receiver 201 may receive the scalable audio bit-stream generated by the encoder 100 of FIG. 1. Thus, the decoder 200 receives an audio bit-stream comprising a first waveform based bit-stream component, a second bit-stream component and a third bit-stream component where the first waveform based bit-stream component and the second bit-stream component correspond to a first representation of the audio signal and the first waveform based bit-stream component and the third bit-stream component correspond to a second representation of the audio signal.

The decode receiver 201 is coupled to a first waveform decoder 203 which generates a first decoded signal by decoding the first waveform based bit-stream component. Thus, the first waveform decoder 203 implements the complementary process to the encoding process applied by the first waveform encoder 103.

The decode receiver 201 is furthermore coupled to a second decoder 205 and a third decoder 207. The second decoder 205 is fed the second bit-stream component and the third decoder 207 is fed the third bit-stream component. In the example of FIG. 2, both the second decoder 205 and the third decoder 207 are furthermore coupled to the first waveform decoder 203 and are fed the first decoded signal there from.

The second decoder 205 is operable to modify the first decoded signal in response to the data of the second bit-stream component in order to generate a second decoded signal which may have an improved quality with respect to the first decoded signal.

Specifically, the second decoder 205 may be a waveform decoder which determines a residual signal by waveform decoding of the second bit-stream component. The second decoder 205 may then proceed to add the residual signal to the first decoded signal thereby generating a more accurate representation of the originally encoded audio signal.

Likewise, the third decoder 207 is operable to modify the first decoded signal in response to the data of the third bit-stream component in order to generate a third decoded signal which may have an improved quality with respect to the first decoded signal.

For example, the third decoder 207 may also be a waveform decoder which determines a residual signal by waveform decoding of the third bit-stream component. In this example, the third bit-stream may correspond to a more accurate coding of the residual signal (at a higher data rate). The third decoder 207 may then proceed to add the residual signal to the first decoded signal thereby generating an even more accurate representation of the originally encoded audio signal than for the second decoded signal.

As another example (which is compatible with the third encoder 107 being a parametric encoder), the third decoder 207 may be a parametric decoder which determines further characteristics of the first signal by decoding of the third bit-stream component. For example, the third encoder 107 may determine multi channel or high frequency characteristics for the first decoded signal and these characteristics may be used to modify the first decoded signal to generate a more accurate and/or a multi channel decoded signal.

Thus, the decoder 200 comprises a second decoder 205 which generates an audio signal corresponding to the first representation of the audio signal in the scalable audio bit-stream, and a third decoder 207 which generates an audio signal corresponding to the second representation of the audio signal in the scalable audio bit-stream.

The second and third decoders 205, 207 are coupled to an output processor 209 which selects between the decoded signals from the decoders 205, 207.

It will be appreciated that in other embodiments, only one of the second and third decoded signals, corresponding to the first and second representation respectively, may be generated by the decoder.

Furthermore, in some embodiments, the decoder may generate both the second and third decoded signals and may re-encode these signals and send them to different encoders. Thus, the decoder 200 may implement a transcoding function wherein the combined scalable audio bit-stream is received and differently encoded bit-streams are generated there from. The different bit streams may then be transmitted to different destinations. Thus, the decoder 200 may be a transcoder providing an interface between the scalable audio bit-stream and different types of decoders.

It will also be appreciated that in some embodiments, the functionality of the first waveform decoder 203 and the second decoder 205 and/or the first waveform decoder 203 and the third decoder 207 are combined. For example, the second decoder 205 may directly combine the first and second bit-stream components to generate encoding data which is decoded together to generate the second decoded signal without receiving a separately generated first decoded signal. Similarly, the third decoder 207 may directly combine the first and third bit-stream components to generate encoding data which is decoded together to generate the third decoded signal without receiving a separately generated first decoded signal. Thus, a common first decoded signal used by both the second decoder 205 and the third decoder 207 need not be generated.

In the following some more specific exemplary embodiments will be described with specific reference to the encoders. It will be appreciated that the principles, characteristics and disclosure of the described embodiments readily can be applied to corresponding decoder embodiments.

Figure 3:
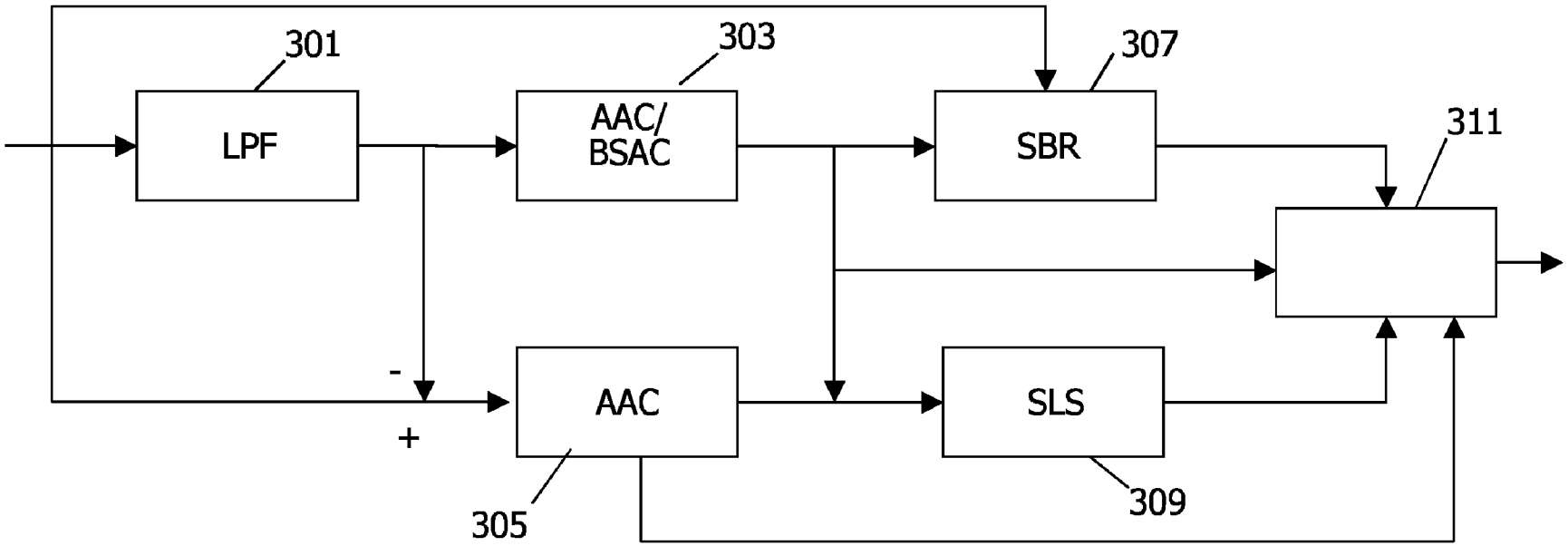
FIG. 3 illustrates an example of an encoder in accordance with some embodiments of the invention.

FIG. 3 illustrates an example of an encoder in accordance with some embodiments of the invention. In the example, a bit-stream is assumed that supports scalability in small steps from low bitrate (lossy) towards high bit-rate lossless, with all coding tools taken from the MPEG-4 audio coding toolbox.

In the example, AAC encoding is used not only for the first waveform encoder but also for the second encoder while a Spectral Band Replication, SBR, encoder is used for the third encoder.

In SBR the shape of the high pitched part of a signal is characterized by the encoder (e.g. in terms of level, tonal to noise ratio, individual tone position and noise floor level). The SBR decoder rebuilds the higher part of the spectrum using these cues plus the lower part of the spectrum transmitted using a core encoder (e.g. AAC). Usually SBR data take only a fraction of the core coder bit rate, typically about 1.5-4 kbps is used to describe the high frequency content when used with AAC at 24 kbps. As a result, the quality obtained using that combination has shown to be improved, in a forward and backward compatible fashion: the core decoder can decode the core stream, discarding the SBR information. An SBR empowered decoder can decode the whole signal. SBR has been successfully applied on AAC in the MPEG-4 framework. The SBR tool can operate in two modes, single rate and dual rate mode. In dual rate mode, the core coder operates at half the sampling frequency and the SBR tool outputs the full sampling frequency. In single rate mode, both the core coder as well as the SBR tool operates at full sampling rate.

In the example of FIG. 3, a low pass filter 301 receives the audio signal and separates this into a high frequency and a low frequency part.

The low frequency part is fed to an MPEG-4 AAC-BSAC coder 303 (i.e. a cascade of an AAC-BSAC encoder and an AAC-BSAC decoder) that operates at half the sampling frequency. The AAC-BSAC coder 303 generates a first bit-stream component representing the lower frequency part of the received audio signal.

The higher frequencies are fed to a regular AAC coder 305 (i.e. a cascade of an AAC encoder and an AAC decoder) operating at half the sampling frequency. The AAC coder 305 generates a second bit-stream component representing the higher frequency part of the received audio signal. In the example, the higher frequency part is derived by subtracting the lower frequency signal from the original audio signal. Thus, the higher frequency part may be considered a residual signal of the signal encoded by the AAC-BSAC coder 303.

In addition, the audio signal is fed to an SBR parametric coder 307, which also receives the encoding data from the AAC-BSAC coder 303. The SBR parametric coder 307 proceeds to generate SBR data using the AAC/BSAC coder 303 as the core coder. Thus the SBR parametric coder 307, generates a third bit-stream component representing enhancement data for the first bit-stream component from the AAC-BSAC coder 303. Specifically, the third bit-stream component comprises parametric higher frequency data for the AAC/BSAC encoded signal.

In the example, the encoder further comprises a further coder which generates enhancement data for the audio signal relative to the first representation of the audio signal made up by the first and second bit-stream components. In particular, the AAC-BSAC coder 303 and the AAC coder 305 are coupled to an SLS coder 309 which determines a residual or error signal, i.e. the difference between the original audio signal and the combined output signals of the AAC/BSAC coder 303 and the AAC coder 309. The residual signal is then lossless coded by means of an SLS algorithm. Thus, a fourth bit-stream component is generated which provides an additional layer of scalability.

It will be appreciated that in some embodiments, a similar approach may be used to generate further enhancement data for the second audio signal representation made up by the first bit-stream component and the third bit-stream component.

The AAC-BSAC coder 303, the AAC coder 305, the SBR parametric coder 307 and the SLS coder 309 are all coupled to an output generator 311 which generates a combined bit-stream including the first, second, third and fourth bit-streams.

Figure 4A:
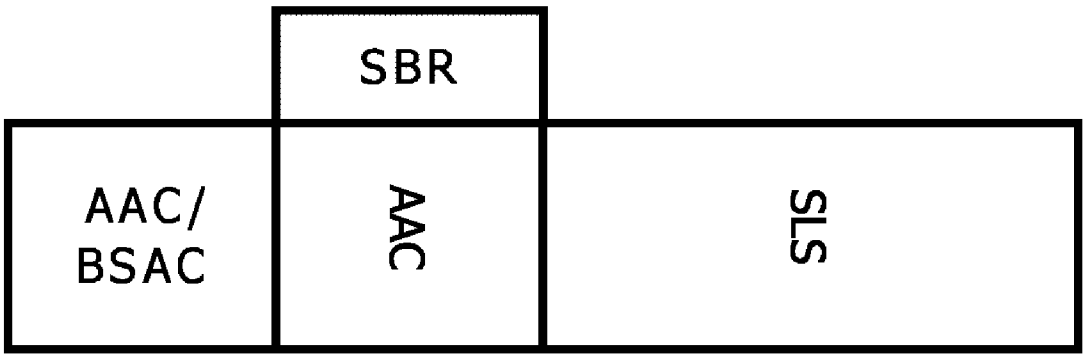
FIG. 4 illustrates an example of a scalable audio bit-stream in accordance with some embodiments of the invention.
Figure 4B:
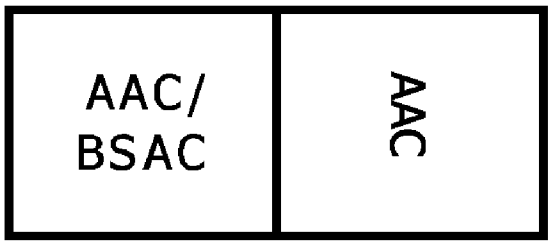
Figure 4C:
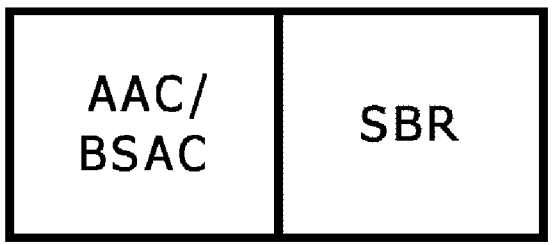

Thus, a scalable encoded audio signal comprising alternative representations of the audio signal may be achieved. As illustrated in FIG. 4, the AAC waveform bit-stream component (i.e. the HF part of the audio signal as encoded by the AAC encoder 305) can be substituted for the SBR bit-stream component. Thus, both the second and third bit-stream components have been derived based on the same core coder. There is flexibility in choosing either of the two bit-streams by a decoder depending on e.g. the bit-rate versus quality trade-off. The AAC/BSAC waveform bit-stream component (the first bit-stream component) represents the low frequency part of the audio signal as encoded by the AAC/BSAC encoder 303. In some embodiments, the low frequency part of the audio signal may be coded by an AAC coder (replacing the AAC/BSAC coder 303 of FIG. 3).

The combination of the AAC/BSAC waveform bit-stream component and the AAC waveform bit-stream component form a first high quality representation of the input audio signal. The combination of the AAC/BSAC waveform bit-stream component and the SBR bit-stream component form a second lower quality representation of the input audio signal (but at reduced bitrate).

Figure 5:
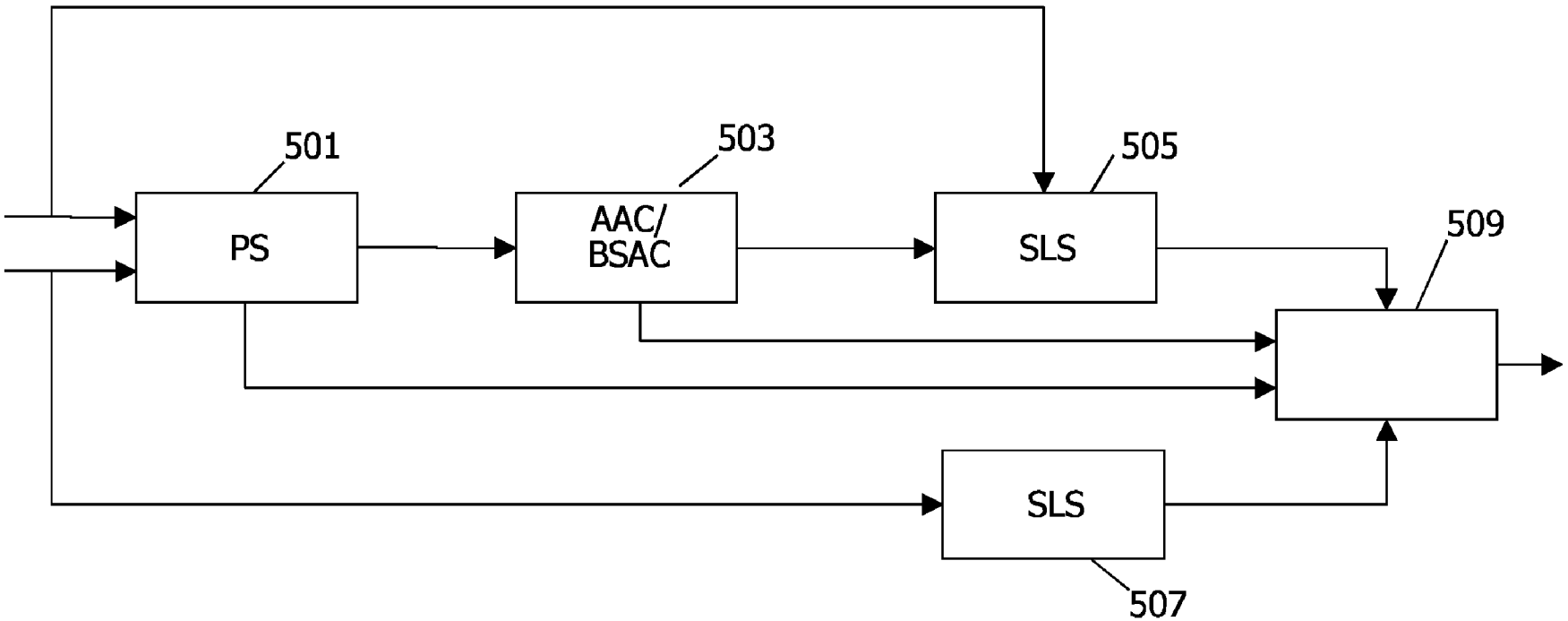
FIG. 5 illustrates an example of an encoder in accordance with some embodiments of the invention.

FIG. 5 illustrates another example of an encoder in accordance with some embodiments of the invention. In this example, a stereo audio signal is encoded.

The encoder comprises a parametric stereo coder 501, which generates parametric stereo data. The parametric stereo coder 501 is coupled to a mono AAC/BSAC coder 503 which generates a mono AAC/BSAC lossy representation of the stereo signal. The parametric stereo coder 501 generates enhancement data allowing a stereo signal to be generated from this signal.

Parametric stereo is an encoding technique which aims at transmitting, along with a mono signal acting as a support, a parametric description of the stereo sound fields. This parametric set of parameters typically uses only a few kbps and stereo may be enabled at rates down to 16 kbps. Parametric stereo has been successfully applied to different techniques including MPEG-4 SSC and AAC+SBR (MPEG-4 High Efficiency AAC v2).

The encoder of FIG. 5 further comprises a first SLS encoder 505 which performs an SLS coding of the residual signal of the left channel signal relative to the mono AAC/BSAC encoded signal. Furthermore, the encoder comprises a second SLS encoder 507, which performs an SLS coding of the right stereo signal.

The parametric stereo coder 501, the mono AAC/BSAC coder 503, the first SLS encoder 505 and the second SLS encoder 507 are all coupled to an output generator 509 which generates a scalable encoded bit-stream comprising the base AAC/BSAC encoding, the parametric stereo parameters and the left and right channel SLS data.

In the example, the parametric bit-stream component may be substituted for the SLS waveform bit-stream components. The combination of the AAC/BSAC waveform bit-stream component and the SLS waveform bit-stream components form a first high quality representation of the input audio signal. The combination of the AAC/BSAC waveform bit-stream component and the parametric stereo bit-stream component form a second lower quality representation of the input audio signal (but at lower bitrate).

Figure 6A:
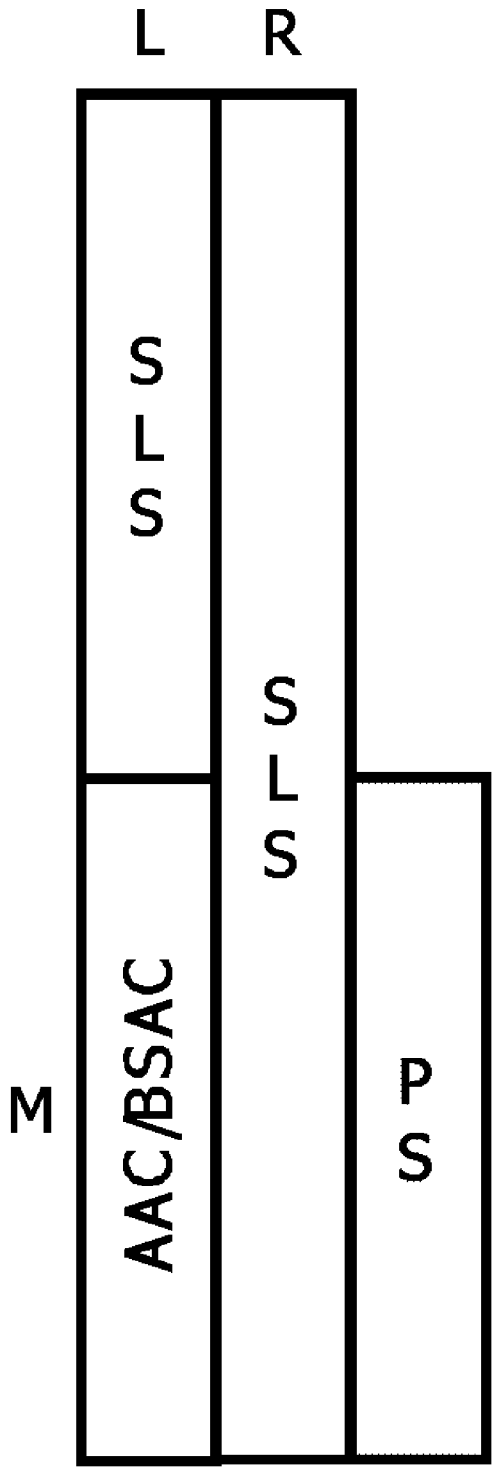
FIG. 6 illustrates an example of a scalable audio bit-stream in accordance with some embodiments of the invention.
Figure 6B:
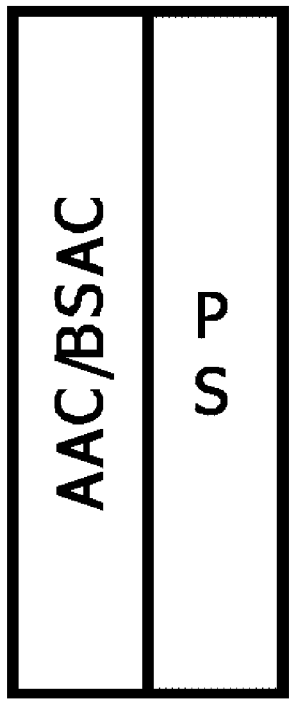

FIG. 6 illustrates examples of such an audio bit-stream. In the first example, the full scalable bit-stream is illustrated. In the example, the SLS residual is based on the AAC/BSAC coder for the left signal. The parametric component has been separately obtained. In the second example, parametric stereo is combined with AAC/BSAC data to create a lossy representation of the stereo signal having a lower bitrate.

Figure 7:
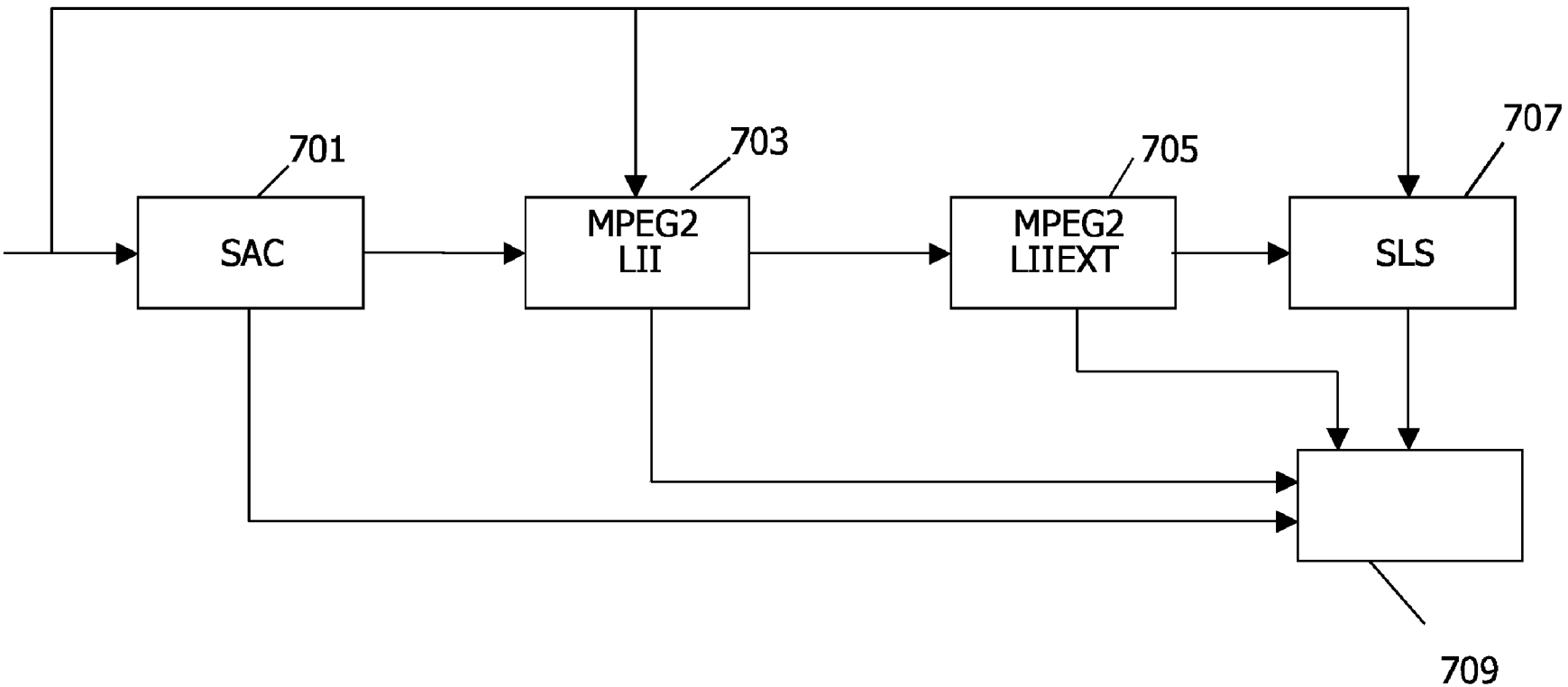
FIG. 7 illustrates an example of an encoder in accordance with some embodiments of the invention.

FIG. 7 illustrates another example of an encoder in accordance with some embodiments of the invention.

In the example, the encoder comprises a spatial audio coder 701, which generates spatial audio data. The spatial audio coder 701 is coupled to a MPEG2-Layer II coder 703 which generates an encoded stereo down-mix which is used as the base data which may be enhanced by the bit-stream generated by the spatial audio coder 701.

Spatial audio coding is a technology which is similar to parametric stereo and which is able to capture the multi-channel image at relatively low bit rates (typically down to around 24 kbps). In combination with a mono or stereo down-mix, a spatial audio decoder is able to regenerate a representation of the multi-channel original. The obvious advantage of this approach is that only the down-mix channels need to be encoded. The spatial side information can be included in the ancillary data portion of the resulting bit-stream allowing compatibility with mono or stereo decoders.

The MPEG-2-Layer II coder 703 is coupled to a MPEG-2-LII extension coder 705. Using MPEG2 matrix technology which will be known to the person skilled in the art, the two channels of the stereo down-mix signal can be converted into a multi-channel representation by the MPEG-2-LII extension coder 705. This data is called MPEG-2-LII multi-channel extension data.

The MPEG-2-LII extension coder 705 is further coupled to an SLS coder 707 which losslessly codes the residual signals using SLS for all the channels.

The spatial audio coder 701, the MPEG-2-Layer II coder 703, the MPEG-2-LII extension coder 705 and the SLS coder 707 are all coupled to an output generator 709 which generates a scalable encoded bit-stream comprising the base MPEG-2-Layer II data, the MPEG-2-LII multi-channel extension data, the SLS data and the spatial audio.

Figure 8A:
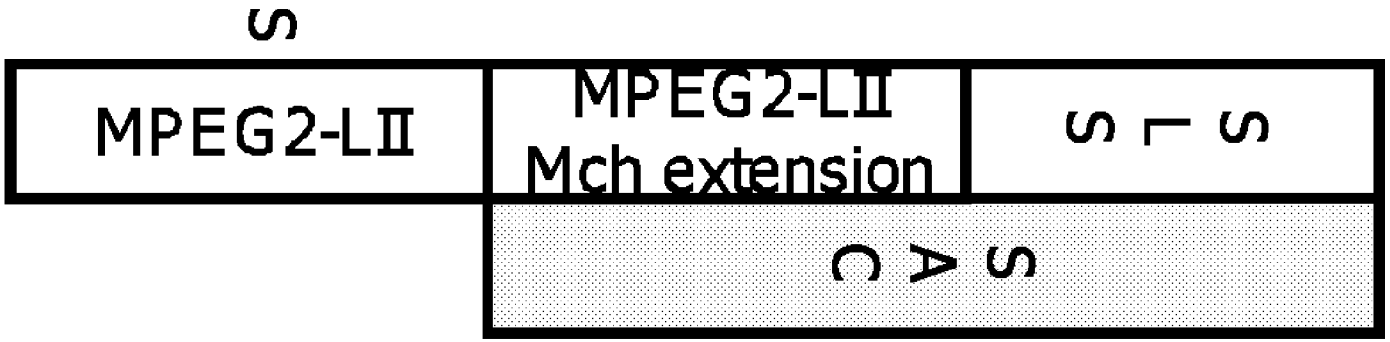
FIG. 8 illustrates an example of a scalable audio bit-stream in accordance with some embodiments of the invention.
Figure 8B:
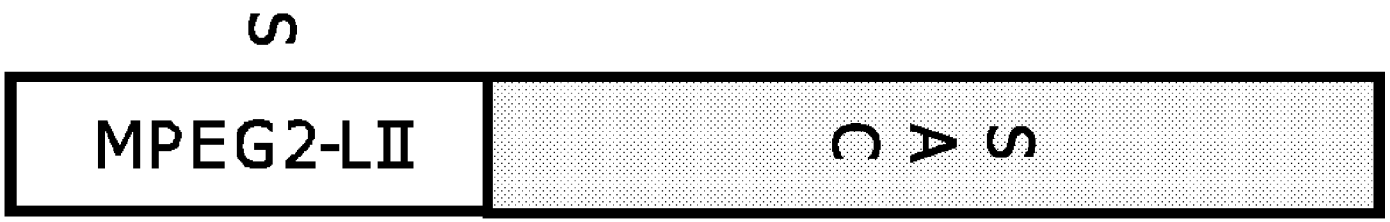

FIG. 8 illustrates examples of such an audio bit-stream. As illustrated, the spatial audio coded bit-stream component can be substituted for the MPEG-2 multi-channel extension and the SLS data. The combination of the MPEG-2-LII waveform bit-stream component and the MPEG-2-LII multi-channel extension and SLS waveform bit-stream component form a first high quality representation of the input audio signal. The combination of the MPEG-2-LII waveform bit-stream component and the spatial audio bit-stream component form a second lower quality representation of the input audio signal (but at lower bit rate).

Thus, in the first example of FIG. 8, the full scalable bit-stream is illustrated. In the example, the SLS residual data is based on the difference of the MPEG-2-LII multi-channel decoded signal and the original signal. The stereo down-mix is created by the spatial encoder. In the second example, the MPEG-2-LII multi-channel data and the SLS data is replaced by the spatial audio data which is more efficient in terms of the required bit rate.

In an alternative embodiment, the SLS coding may also replace the MPEG-2 LII extension bit-stream component.

It will be appreciated that although the described embodiments have focussed on embodiments where two alternative representations of the audio signal were included in a scalable bit-stream, three or more representations may be used in other embodiments. For example, an encoder may comprise both a waveform encoder, a parametric stereo coder and an SBR encoder for generating extension data for the same underlying base coder.

It will also be appreciated that the described bit-streams may be applied in different ways. For example, the bit-stream may be transcoded at the transmission side (resulting in e.g. a reduced stored or transmitted bit-rate), or may be transcoded at the receiving side (resulting in an e.g. reduced decoder complexity or support for other channel configurations). It will also be appreciated that transcoding is merely optional and that the concepts may be employed without any transcoding being involved.

Figure 9:
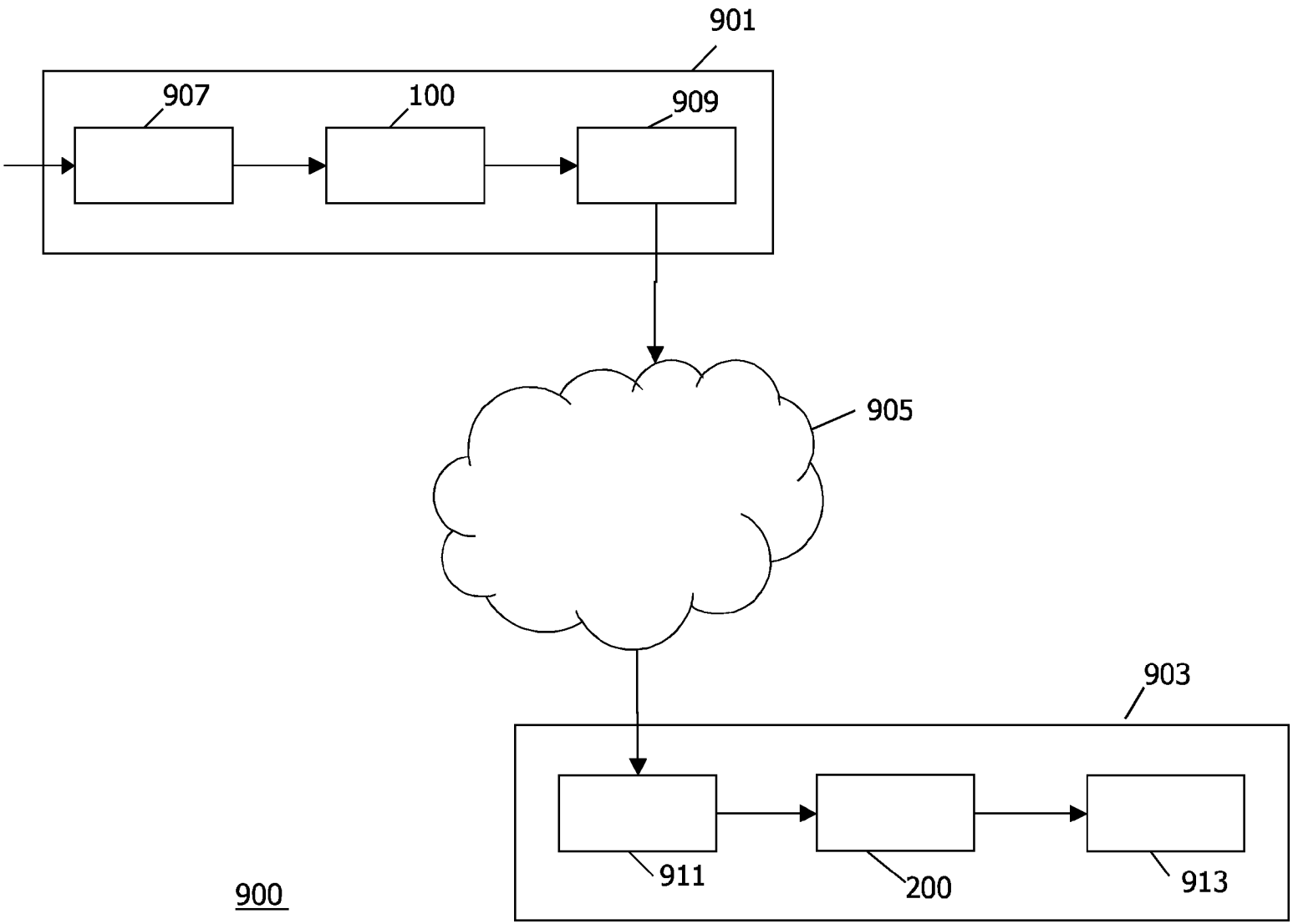
FIG. 9 illustrates a transmission system for communication of an audio signal in accordance with some embodiments of the invention.

FIG. 9 illustrates a transmission system 900 for communication of an audio signal in accordance with some embodiments of the invention. The transmission system 900 comprises a transmitter 901 which is coupled to a receiver 903 through a network 905 which specifically may be the Internet.

In the specific example, the transmitter is a signal recording device and the receiver is a signal player device but it will be appreciated that in other embodiments a transmitter and receiver may used in other applications. For example, the transmitter and/or the receiver may be part of a transcoding functionality and may e.g. provide interfacing to other signal sources or destinations.

In the specific example where a signal recording function is supported, the transmitter 901 comprises a digitizer 907 which receives an analog signal that is converted to a digital PCM signal by sampling and analog-to-digital conversion.

The transmitter 901 is coupled to the encoder 100 of FIG. 1 which encodes the PCM signal as previously described. The encoder 100 is coupled to a network transmitter 909 which receives the encoded signal and interfaces to the Internet to transmit the encoded signal to the receiver 903 through the Internet 905.

The receiver 903 comprises a network receiver 911 which interfaces to the Internet 905 to receive the encoded signal from the transmitter 901.

The network receiver 911 is coupled to the decoder 200 of FIG. 2. The decoder 200 receives the encoded signal and decodes it as previously described. In particular, the decoder 911 may decode the first representation or the second representation.

In the specific example where a signal playing function is supported, the receiver 903 further comprises a signal player 913 which receives the decoded audio signal from the decoder 200 and presents this to the user. Specifically, the signal player 913 may comprise a digital-to-analog converter, amplifiers and speakers as required for outputting the multi-channel audio signal.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A decoder for generating a multi-channel audio signal from a scalable audio bit-stream, the decoder comprising:

means for receiving the scalable audio bit-stream comprising a first waveform based bit-stream component, a second bit-stream component comprising first multi channel extension data and a third bit-stream component comprising second alternative multi channel extension data, the first waveform based bit-stream component and the second bit-stream component corresponding to a first representation of the multi channel audio signal and the first waveform based bit-stream component and the third bit-stream component corresponding to a second representation of the multi channel audio signal;

a first waveform decoder for generating a first decoded signal for at least a first channel of the multi channel audio signal by decoding the first waveform based bit-stream component;

and at least one of:

a second decoder for generating the multi channel audio signal by modifying the first decoded signal in response to the second bit-stream component, and a third decoder for generating the multi channel audio signal by modifying the first decoded signal in response to the third bit-stream component.

2. The decoder as claimed in claim 1, wherein the second bit-stream component is a waveform based bit-stream component, and the second decoder is a waveform decoder.

3. The decoder as claimed in claim 1, wherein the third bit-stream component is a parametric based bit-stream component, and the third decoder is a parametric decoder.

4. The decoder as claimed in claim 1, wherein an encoding quality of the first representation is higher than an encoding quality of the second representation.

5. The decoder as claimed in claim 1, wherein said decoder comprises both the second decoder and the third decoder, and the decoder further comprises means for selecting between the second decoder and the third decoder for decoding of the scalable audio bit-stream.

6. The decoder as claimed in claim 1, wherein the first waveform decoder is an Advanced Audio Coding (AAC) decoder.

7. The decoder as claimed in claim 1, wherein the first waveform decoder is an MPEG-2 LII decoder.

8. The decoder as claimed in claim 1, wherein the third decoder is a Parametric Stereo (PS) decoder.

9. The decoder as claimed in claim 1, wherein the third decoder is a Spatial Audio Coder (SAC) decoder.

10. The decoder as claimed in claim 1, wherein the second decoder is a Scaleable to Lossless Standard (SLS) decoder.

11. The decoder as claimed in claim 1, wherein the second decoder is an MPEG-2 LII multi-channel extension encoder.

12. The decoder as claimed in claim 1, wherein the decoder is an MPEG-4 decoder.

13. The decoder as claimed in claim 1, wherein the scalable audio bit-stream further comprises enhancement data for the multi-channel audio signal relative to the first representation, and wherein the decoder further comprises means for generating the multi-channel audio signal in response to the enhancement data.

14. The decoder as claimed in claim 1, wherein the scalable audio bit-stream further comprises enhancement data for the multi-channel audio signal relative to the second representation, and wherein the decoder further comprises means for generating the multi-channel audio signal in response to the enhancement data.

15. The decoder as claimed in claim 1, wherein the scalable audio bit-stream further comprises a fourth bit-stream component, and wherein the decoder comprises a fourth decoder for generating the multi-channel audio signal by modifying the first decoded signal in response to the fourth bit-stream component.

16. An audio playing device comprising a decoder as claimed in claim 1.

17. An encoder for encoding a multi-channel audio signal in a scalable audio bit-stream, the encoder comprising:

a first waveform encoder for encoding at least a first channel of the multi-channel audio signal into a first waveform-based bit-stream component;

a second encoder for encoding the multi-channel audio signal to generate a second bit-stream component comprising first multi-channel extension enhancement data for the first waveform-based bit-stream component, the first waveform-based bit-stream component and the second bit-stream component corresponding to a first representation of the multi-channel audio signal;

a third encoder for encoding the multi-channel audio signal to generate a third bit-stream component comprising second alternative multi-channel extension enhancement data for the first waveform-based bit-stream component, the first waveform-based bit-stream component and the third bit-stream component corresponding to a second representation of the multi-channel audio signal; and means for generating the scalable audio bit-stream comprising the first waveform-based bit-stream component, the second bit-stream component and the third bit-stream component.

18. An audio recording device comprising an encoder as claimed in claim 17.

19. A method of generating a multi-channel audio signal from a scalable audio bit-stream, the method comprising:

receiving the scalable audio bit-stream comprising a first waveform-based bit-stream component, a second bit-stream component comprising first multi-channel extension data and a third bit-stream component comprising second alternative multi-channel extension data, the first waveform-based bit-stream component and the second bit-stream component corresponding to a first representation of the multi-channel audio signal, and the first waveform-based bit-stream component and the third bit-stream component corresponding to a second alternative representation of the multi-channel audio signal;

generating a first decoded signal for at least a first channel of the multi-channel audio signal by decoding the first waveform-based bit-stream component; and at least one of:

generating the multi-channel audio signal by modifying the first decoded signal in response to the second bit-stream component, and generating the multi-channel audio signal by modifying the first decoded signal in response to the third bit-stream component.

20. A non-transitory computer-readable storage medium embodying a computer program comprising instructions for causing a processor, when executing said computer program, to execute the method as claimed in claim 19.

21. A method of encoding a multi-channel audio signal in a scalable audio bit-stream, the method comprising:

encoding at least a first channel of the multi-channel audio signal into a first waveform-based bit-stream component;

encoding the multi-channel audio signal to generate a second bit-stream component comprising first multi-channel extension enhancement data for the first waveform-based bit-stream component, the first waveform-based bit-stream component and the second bit-stream component corresponding to a first representation of the multi-channel audio signal;

encoding the multi-channel audio signal to generate a third bit-stream component comprising second alternative multi-channel extension enhancement data for the first waveform-based bit-stream component, the first waveform-based bit-stream component and the third bit-stream component corresponding to a second representation of the multi-channel audio signal; and generating the scalable audio bit-stream comprising the first waveform-based bit-stream component, the second bit-stream component and the third bit-stream component.

22. A non-transitory computer-readable storage medium having stored therein a scalable audio bit-stream for an multi-channel audio signal comprising a first waveform-based bit-stream component, a second bit-stream component comprising first multi-channel extension data and a third bit-stream component comprising second alternative multi-channel extension data, the first waveform-based bit-stream component and the second bit-stream component corresponding to a first representation of the multi-channel audio signal and the first waveform-based bit-stream component, and the third bit-stream component corresponding to a second alternative representation of the multi-channel audio signal.

23. A receiver for receiving a scalable multi-channel audio bit-stream, the receiver comprising:

means for receiving the scalable multi-channel audio bit-stream comprising a first waveform-based bit-stream component comprising first multi-channel extension data, a second bit-stream component and a third bit-stream component comprising second alternative multi-channel extension data, the first waveform-based bit-stream component and the second bit-stream component corresponding to a first representation of the multi-channel audio signal, and the first waveform-based bit-stream component and the third bit-stream component corresponding to a second representation of the multi-channel audio signal;

a first waveform decoder for generating a first decoded signal for at least a first channel of the multi-channel audio signal by decoding the first waveform-based bit-stream component;

and at least one of:

a second decoder for generating the multi-channel audio signal by modifying the first decoded signal in response to the second bit-stream component, and a third decoder for generating the multi-channel audio signal by modifying the first decoded signal in response to the third bit-stream component.

24. A transmitter for transmitting a multi-channel audio signal in a scalable audio bit-stream, the transmitter comprising:

a first waveform encoder for encoding at least a first channel of the multi-channel audio signal into a first waveform-based bit-stream component;

a second encoder for encoding the multi-channel audio signal to generate a second bit-stream component comprising first multi-channel extension enhancement data for the first waveform-based bit-stream component, the first waveform-based bit-stream component and the second bit-stream component corresponding to a first representation of the multi-channel audio signal;

a third encoder for encoding the multi-channel audio signal to generate a third bit-stream component comprising second alternative multi-channel extension enhancement data for the first waveform-based bit-stream component, the first waveform-based bit-stream component and the third bit-stream component corresponding to a second representation of the multi-channel audio signal;

means for generating the scalable audio bit-stream comprising the first waveform-based bit-stream component, the second bit-stream component and the third bit-stream component; and means for transmitting the scalable audio bit-stream.

25. A transmission system for transmitting and receiving a multi-channel audio signal, the transmission system comprising:

a transmitter comprising:

a first waveform encoder for encoding at least a first channel of the multi-channel audio signal into a first waveform-based bit-stream component, a second encoder for encoding the multi-channel audio signal to generate a second bit-stream component comprising first multi-channel extension enhancement data for the first waveform-based bit-stream component, the first waveform-based bit-stream component and the second bit-stream component corresponding to a first representation of the multi-channel audio signal, a third encoder for encoding the multi-channel audio signal to generate a third bit-stream component comprising second alternative multi-channel extension enhancement data for the first waveform-based bit-stream component, the first waveform-based bit-stream component and the third bit-stream component corresponding to a second representation of the multi-channel audio signal, means for generating the scalable audio bit-stream comprising the first waveform-based bit-stream component, the second bit-stream component and the third bit-stream component, and means for transmitting the scalable audio bit-stream; and a receiver comprising:

means for receiving the scalable audio bit-stream;

a first waveform decoder for generating a first decoded signal by decoding the first waveform-based bit-stream component;

and at least one of:

a second decoder for generating the multi-channel audio signal by modifying the first decoded signal in response to the second bit-stream component, and a third decoder for generating the multi-channel audio signal by modifying the first decoded signal in response to the third bit-stream component.

26. A method of receiving a multi-channel audio signal from a scalable audio bit-stream, the method comprising:

receiving the scalable audio bit-stream comprising a first waveform-based bit-stream component, a second bit-stream component comprising first multi-channel extension data, and a third bit-stream component comprising second alternative multi-channel extension data, the first waveform-based bit-stream component and the second bit-stream component corresponding to a first representation of the multi-channel audio signal, and the first waveform-based bit-stream component and the third bit-stream component corresponding to a second representation of the multi-channel audio signal;

generating a first decoded signal for at least a first channel of the multi-channel audio signal by decoding the first waveform-based bit-stream component;

and at least one of:

generating the multi-channel audio signal by modifying the first decoded signal in response to the second bit-stream component, and generating the multi-channel audio signal by modifying the first decoded signal in response to the third bit-stream component.

27. A method of transmitting a multi-channel audio signal in a scalable audio bit-stream, the method comprising:

encoding at least a first channel of the multi-channel audio signal into a first waveform-based bit-stream component;

encoding the multi-channel audio signal to generate a second bit-stream component comprising first multi-channel extension enhancement data for the first waveform-based bit-stream component, the first waveform-based bit-stream component and the second bit-stream component corresponding to a first representation of the multi-channel audio signal;

encoding the multi-channel audio signal to generate a third bit-stream component comprising second alternative multi-channel extension enhancement data for the first waveform-based bit-stream component, the first waveform-based bit-stream component and the third bit-stream component corresponding to a second representation of the multi-channel audio signal;

generating the scalable audio bit-stream comprising the first waveform-based bit-stream component, the second bit-stream component and the third bit-stream component; and transmitting the scalable audio bit-stream.

28. A method of transmitting and receiving a multi-channel audio signal, the method comprising:

encoding at least a first channel of the multi-channel audio signal into a first waveform-based bit-stream component;

encoding the multi-channel audio signal to generate a second bit-stream component comprising first multi-channel extension enhancement data for the first waveform-based bit-stream component, the first waveform-based bit-stream component and the second bit-stream component corresponding to a first representation of the multi-channel audio signal;

encoding the multi-channel audio signal to generate a third bit-stream component comprising second alternative multi-channel extension enhancement data for the first waveform-based bit-stream component, the first waveform-based bit-stream component and the third bit-stream component corresponding to a second representation of the multi-channel audio signal;

generating the scalable audio bit-stream comprising the first waveform-based bit-stream component, the second bit-stream component and the third bit-stream component;

transmitting the scalable audio bit-stream;

receiving the scalable audio bit-stream;

generating a first decoded signal by decoding the first waveform-based bit-stream component;

and at least one of:

generating the multi-channel audio signal by modifying the first decoded signal in response to the second bit-stream component, and generating the multi-channel audio signal by modifying the first decoded signal in response to the third bit-stream component.

* * * * *